US008695753B2

(12) United States Patent
Goossens et al.

(10) Patent No.: US 8,695,753 B2
(45) Date of Patent: Apr. 15, 2014

(54) MASS LOADING FOR PISTON LOUDSPEAKERS

(75) Inventors: Karel Goossens, Heusden (BE); Onur Ilkorur, Ghent (BE); David Corynen, Brakel (BE); Charalampos Ferekidis, Detmold (DE); Karl-Heinz Fink, Essen (DE)

(73) Assignee: PSS Belgium NV, Dendermonde (BE)

( * ) Notice: Subject to any disclaimer, the term of this patent is extended or adjusted under 35 U.S.C. 154(b) by 0 days.

(21) Appl. No.: 13/581,118

(22) PCT Filed: Feb. 21, 2011

(86) PCT No.: PCT/IB2011/000441

§ 371 (c)(1),
(2), (4) Date: Nov. 5, 2012

(87) PCT Pub. No.: WO2011/104624

PCT Pub. Date: Sep. 1, 2011

(65) Prior Publication Data

US 2013/0056296 A1 Mar. 7, 2013

(30) Foreign Application Priority Data

Feb. 26, 2010 (GB) ..... 1003338.9

(51) Int. Cl.
*G10K 13/00* (2006.01)

(52) U.S. Cl.
USPC ..... 181/167; 181/166

(58) Field of Classification Search
USPC ..... 181/166, 167
See application file for complete search history.

(56) References Cited

U.S. PATENT DOCUMENTS

| | | | | |
|---|---|---|---|---|
| 1,560,552 | A | 11/1925 | Esterbrook | |
| 5,304,746 | A | 4/1994 | Purvine | |
| 6,224,801 | B1 | 5/2001 | Mango, III | |
| 7,916,878 | B2 * | 3/2011 | Bank et al. | 381/152 |
| 8,077,903 | B2 * | 12/2011 | McKenzie | 381/426 |
| 8,397,861 | B1 * | 3/2013 | Xu et al. | 181/171 |
| 2009/0285431 | A1 * | 11/2009 | Carlson et al. | 381/345 |
| 2010/0236861 | A1 * | 9/2010 | Her et al. | 181/164 |

FOREIGN PATENT DOCUMENTS

| | | | |
|---|---|---|---|
| DE | 19504453 | | 1/1996 |
| GB | 1488541 | A | 10/1977 |
| GB | 2087688 | A | 5/1982 |
| JP | 56098096 | A | 8/1981 |
| JP | 2000184492 | A | 6/2000 |
| WF | WO95/01080 | | 1/1995 |
| WO | WO02/045460 | A2 | 6/2002 |
| WO | WO2009/080055 | A1 | 7/2009 |

* cited by examiner

*Primary Examiner* — Forrest M Phillips
(74) *Attorney, Agent, or Firm* — Peter A. Nieves; Sheehan Phinney Bass + Green, PA

(57) ABSTRACT

A diaphragm for a loudspeaker including a plurality of masses, each mass being substantially the same radial distance from the center of the diaphragm, the plurality of masses being divided into two arrays, each array including one or more individual masses, wherein, in use, at a selected frequency, the pair of arrays act to produce a dominant bending moment, and, the center of the diaphragm lies substantially on the axis of the dominant bending moment, wherein, the dominant bending moment is the bending moment produced by the combination of masses which has the greatest magnitude, if they produce more than one bending moment.

24 Claims, 16 Drawing Sheets

FIG 8
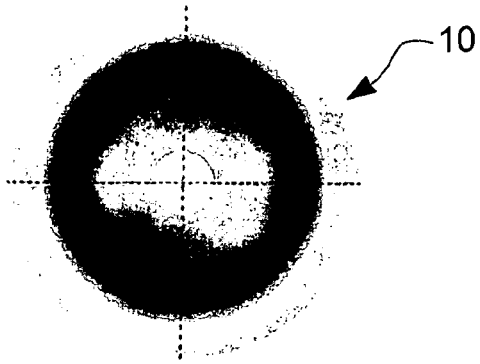
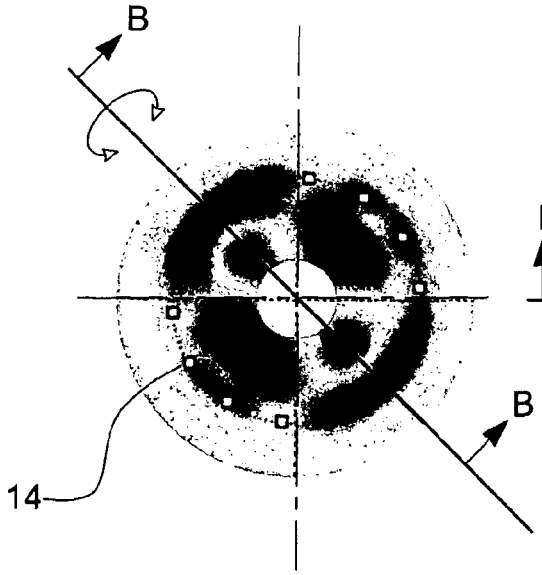
FIG 9
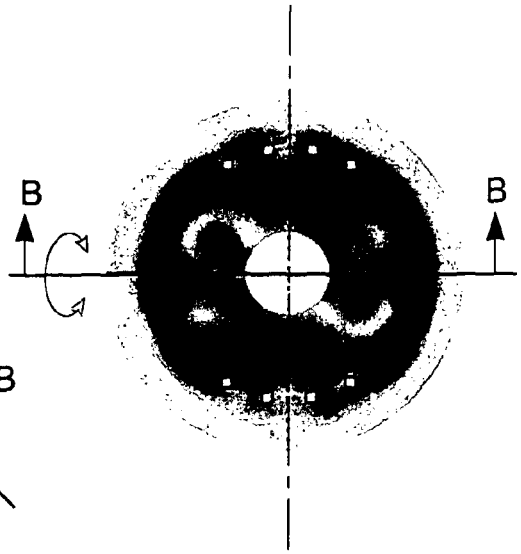
FIG 10

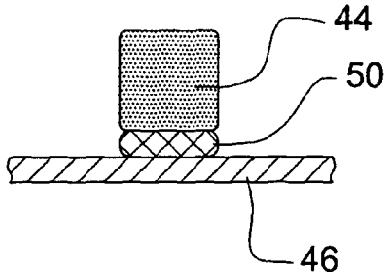
FIG 21
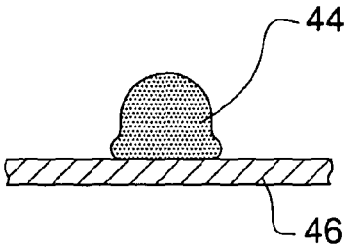
FIG 22
FIG 23
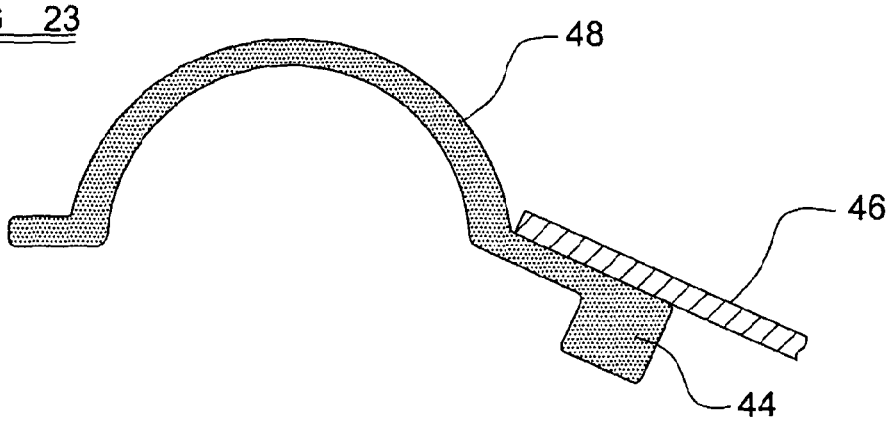
FIG 24
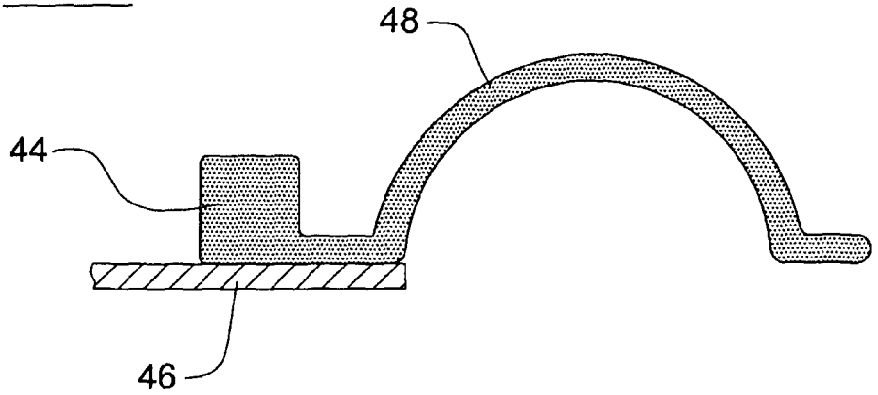

MASS LOADING FOR PISTON LOUDSPEAKERS

This invention relates to piston loudspeakers, such as cone loudspeakers, known for transforming electric energy (audio signal) into acoustic energy (sound). These devices are equipped with a movable diaphragm (e.g. conical shaped, flat shaped or other shaped) driven by a voice-coil that reacts with a magnet structure.

Because of geometrical and material constraints, the diaphragm of a piston loudspeaker tends to break up into problematic ring shaped resonances at certain frequencies.

Loudspeaker diaphragms vibrate in piston mode at low frequencies: all points on the diaphragm have approximately the same amplitude and phase. At higher frequencies bending modes become dominant over the cone/diaphragm up until the transition frequency where bending waves become dominant.

Two types of break up modes are distinguished: radial and circular modes.

For radial modes, the waves start at the driving point (voice coil) and travel radially towards the rim, where they are partially reflected back to the voice coil. For certain frequencies, where the reflected wave coincides with the original wave, a standing wave occurs, with displacement nodes (zero excursion) and maxima (maximum excursion) at a fixed position (radius) on the diaphragm creating a ring shaped resonance that has uniform phase and amplitude over the circle described by the radius. These radial modes cause peaks and dips in the frequency response of the SPL (Sound Pressure Level), see e.g. the dashed lines in FIGS. 1 and 2 which are discussed in more detail below. It is desirable to smooth these peaks and dips in the SPL curve, e.g. as shown by the solid line in FIG. 1.

This is also illustrated in FIG. 3, which shows a speaker 10 operating in a resonant break up mode. The diaphragm 12 has at a radius r a maxima of a standing wave.

For circular modes, the waves travel in the direction of a circle, concentric to the axis of the loudspeaker. They are caused by unwanted imperfections in the rotational symmetry of the diaphragm and surround, such as variation of the density or thickness of the cone body, lead wires attached to the cone, etc. The circular modes usually do not contribute to the SPL, because of phase cancellation between different areas of the cone.

One attempt to reduce this effect is in WO2005101899A2 which describes how to reduce the net transverse modal velocity over the diaphragm by selection of position and mass of the voice coil and minimum one mechanical impedance means coupled to the diaphragm. This is illustrated in FIG. 4 in which on a diaphragm 15 is located three rings 20, 22 and 24 around the voice coil 26. One further approach, shown in FIG. 5, is that annular mass loading is generally applied on cone loudspeakers in the form of a bead 30 of elastic material located at the edge between surround and cone-body in order to affect the behaviour of the cone edge at a certain frequency. Furthermore, annular mass loading the cone on the radius where the amplitude of the radial mode is maximal (see FIG. 6) does not solve the problem. It does not bring a solution for peaks and dips in SPL caused by this radial mode; it only shifts the peaks and dips to a lower frequency (solid line in FIG. 2) but it does not minimize them and thus it brings no solution to this problem.

The present invention aims to provide a loudspeaker which reduces the effect of radial break up mode(s). In a further aspect, the present invention provides a method of designing and/or fabricating such a speaker.

In its most general sense, in one aspect the invention provides a speaker having a diaphragm which includes at least two additional masses located at substantially the same radial distance from the centre of the diaphragm. These two masses are not continuous i.e. do not join up in order to create a circular mass as in the prior art. Because the masses are separate from each other i.e. not continuous, their action is such that the amplitude and/or phase of any standing wave at that radius is not uniform around the whole diaphragm. This acts to damp or reduce the standing wave in an improved way. Preferably, the radius at which the masses are located corresponds to the or a ring resonance frequency of the speaker.

In another aspect, the invention provides a speaker having a diaphragm which has some damping means applied. These damping means may be masses, areas of increased stiffness or any other means of damping unwanted vibrations. The damping means are applied to some segments of the diaphragm, on opposite sides of the centre of the diaphragm, such that they create a line of maximum damping across the surface of the diaphragm, the line substantially passing through the centre of the diaphragm (the voice coil). Of course, this line of maximum damping will usually exist along a diameter of a circular diaphragm, but can equally be across the surface of diaphragms of other shapes (for example, ellipses). At a certain frequency, where ring resonance would normally occur, the damping means will damp the resonant vibrations in the segments in which they are applied and resonant vibrations will continue in the undamped areas. In this way, as above, the amplitude and/or phase of any standing wave is not uniform around the whole diaphragm. The standing wave is therefore reduced in an improved way. In the undamped areas, a maximum bending moment will normally occur, which too substantially passes through the centre of the diaphragm.

Usually, damping means will be applied symmetrically about the diaphragm's surface on opposite sides of the centre of the diaphragm, in which case, the maximum bending moment will be induced between the damped portions and thus the line of maximum damping and the maximum bending moment will be orthogonal.

As above and according to an embodiment, the damping means may be masses distributed on the surface of the diaphragm. Usually these masses will be distributed in two arrays, on opposite sides of the centre of the diaphragm, at a given radius (where is the diaphragm is circular). The radius at which they are distributed is that at which ring resonance will usually occur at a certain frequency. In embodiments where the diaphragm is not circular, the arrays are usually distributed circumferentially along a pathway where ring resonance would occur at a certain frequency. For example, in the case of an elliptical diaphragm, the arrays extend along a circumferential path at a constant proportion of the radial distance at that point.

It will be understood that each array of masses is simply a group of masses. In an array, the masses are arranged such that they follow a circumferential pathway, as this is the pathway around which ring resonant vibrations would be maximal. Other arrangements of masses could, of course, be used in accordance with the invention, or each array may even only consist of one mass.

According to further embodiments, the invention can also be defined with reference to the spacing of the arrays, or other damping means. As above, often the damping means will be on opposite sides of the centre of the diaphragm. Where the damping means are arrays of masses, this means that the distance between adjacent arrays will be significantly larger than the distance between adjacent masses. In some embodiments, the gap between adjacent arrays may even be twice that between masses in arrays.

It is possible that there may be more than one ring resonance, occurring at more than one frequency on the diaphragm, which is desired to be reduced. In these cases, more than one set of damping means may be applied to the diaphragm, each targeting a different ring resonance, at each respective different radius. In these cases, there may be more than one line of maximum damping, and consequently more than one bending moment induced in the diaphragm throughout a range of frequencies.

The invention may also be thought of in terms of the damping of unwanted vibrations in certain areas. In this sense, areas of the diaphragm are damped by e.g. mass arrays, and areas are undamped. There may be individual areas of the diaphragm which need to be damped and these are the ones which are targeted. There are points of the diaphragm which have maximum damping and a substantially straight line joining these is the line of maximum damping. Similarly, the maximum bending moment will not be induced along a straight line as graphically depicted in the figures, but rather in areas where resonance causes maximal vibrations. A substantially straight line which joins these areas of maximum bending can be defined as the maximum bending moment. For the avoidance of doubt, the maximum bending moment and the line of maximum damping will often be orthogonal, and as arrays are placed on opposite sides of the centre of the diaphragm, the line of maximum damping can be usually said to pass through the centre of the diaphragm.

According to an aspect of the invention, there is provided a diaphragm for a loudspeaker including a plurality of masses, each mass being substantially the same radial distance from the centre of the diaphragm, the plurality of masses being divided into two arrays, each array including one or more individual masses, wherein, in use, at a selected frequency, the pair of arrays act to produce a dominant bending moment, and, the centre of the diaphragm lies substantially on the axis of the dominant bending moment, wherein, the dominant bending moment is the bending moment produced by the combination of masses which has the greatest magnitude, if they produce more than one bending moment.

Preferably each array is a group of masses arranged around a predetermined linear path and, as the ring resonances generally exist in rings in the circumferential direction around the centre of the diaphragm, even more preferably this path extends in a circumferential direction around the diaphragm.

Optionally, it has been found to be beneficial if the spacing of each mass in each array is constant.

In some circumstances, each or any array of masses may contain only one mass, or exactly two masses. Optionally, the arrays are substantially symmetrical about a diameter of the diaphragm.

In some instances, more then one ring resonance may be targeted. In the case where a second ring resonance may be targeted, a diaphragm as previously described may further include: a second plurality of masses divided into two further arrays, each array including one or more individual masses, wherein, in use, at a selected frequency, the pair of further arrays act to produce a second dominant bending moment, and, the centre of the diaphragm lies substantially on the axis of the dominant bending moment, each mass in the second plurality of masses is substantially the same radial distance from the centre of the diaphragm, wherein, this distance is different from that of the first plurality of masses.

It has been found, experimentally, to be beneficial if masses are formed from an internally damped material, so beneficially the masses may be made from an elastic, or internally damped, material.

Preferably, this elastic, or internally damped, material is rubber, silicone, foam rubber, or other product with an elastic modulus of less than 1 GPa.

Often, diaphragms for loudspeakers are mounted using an annular roll suspension which suspends them from their mount in a sprung manner. Beneficially, for manufacturing efficiency therefore, at least one of the plurality of masses may be integrated with the annular roll suspension.

Often the masses will be attached to the diaphragm using adhesive. Advantageously, for manufacturing efficiency, the masses may even be formed from drops or beads of adhesive.

Where adhesive has been used, either as the masses, or for attaching the masses, it is preferable that the adhesive is elastic or internally damped, as this has been shown experimentally to give an improved (smoothed) SPL (Sound Pressure Level) curve. Ideally, the elastic modulus of the adhesive is below 1 GPa.

Another way of defining an aspect of the invention is with reference to the spacing of the masses, in which case the invention provides a diaphragm for a loudspeaker including a plurality of masses, each mass being substantially the same radial distance from the centre of the diaphragm, the plurality of masses being divided into two arrays, each array including one or more individual masses, wherein, the circumferential distance between each adjacent mass in an array is less than the circumferential distance between adjacent arrays.

Optionally, the circumferential distance between each subsequent mass in an array may even be 50% or less of the circumferential distance between subsequent arrays.

An aspect of the invention may also provide a diaphragm for a loudspeaker, the surface of the diaphragm including two uninterrupted circumferential spaces on its surface at a given radius, the circumferential spaces being separated by two interrupting arrays of masses, each array including one or more individual masses, each at the same radial distance from the centre of the diaphragm, wherein, the circumferential length of each gap is larger than the circumferential spacing between subsequent masses in an array.

According to a further aspect, the invention may provide a diaphragm for a loudspeaker including a plurality of masses, each mass being substantially the same radial distance from the centre of the diaphragm, the plurality of masses being divided into two arrays, each array including one or more individual masses, wherein, in use, at a selected frequency, the pair of arrays act to damp resonance in areas of the diaphragm to which to they are attached, thereby reducing ring resonance around the surface of the diaphragm at said radial distance.

According to a further aspect, the invention may provide a diaphragm for a loudspeaker including a plurality of masses, each mass being substantially the same radial distance from the centre of the diaphragm, the plurality of masses being divided into two arrays, each array including one or more individual masses, wherein, from the centre of the diaphragm, there is an angle of at least 90° between adjacent array of masses.

According to a yet further aspect, the invention may also provide a diaphragm for a loud speaker including a plurality of masses, the plurality of masses being divided into two arrays, each array including one or more individual masses, each array extending in an elliptical pathway around the diaphragm, wherein, in use, at a selected frequency, the pair of arrays acts to produce a dominant bending moment, and, the centre of the diaphragm lies substantially on the axis of the dominant bending moment, wherein, the dominant bending moment is the bending moment produced by the combination of masses which has the greatest magnitude, if they produce more than one bending moment.

The invention may also provide a method of producing a dominant bending moment in a diaphragm, including: attaching a plurality of masses to the diaphragm, wherein each mass lies at the same radial distance from the centre of the diaphragm, the plurality of masses being divided into two arrays, each array including one or more individual masses, wherein, in use, at a selected frequency, the pair of arrays act to produce a dominant bending moment, and, the centre of the diaphragm lies substantially on the axis of the dominant bending moment.

According to a further aspect, the invention also provides a method of producing a dominant bending moment in a diaphragm, including: attaching damping means to the diaphragm, wherein, in use, at a selected frequency, the damping means acts to produce a dominant bending moment, and, the centre of the diaphragm lies substantially on the axis of the dominant bending moment.

According to a yet further aspect, the invention provides a method of interrupting ring shaped resonances at selected frequencies on the diaphragm of a loudspeaker, the method including: placing two arrays of one or more masses, each mass being at substantially the same radial distance from the centre of the diaphragm, on the surface of the diaphragm, wherein, maximum resonance damping occurs along the diameter of a diaphragm linking the arrays, thereby reducing ring shaped resonance.

In a further aspect of the invention, there is provided a diaphragm for a loudspeaker including a plurality of masses, each mass being substantially the same radial distance from the centre of the diaphragm, the plurality of masses being divided into two arrays, each array including one or more individual masses, wherein, in use, at a selected frequency, the pair of arrays act to increase stiffness across a given diameter of the diaphragm by damping resonance across said diameter of the diaphragm.

An aspect of the invention may also be considered as a method of inducing resonant vibrations in pre-determined zones of a diaphragm including, placing a plurality of masses on the diaphragm, each mass being substantially the same radial distance from the centre of the diaphragm, the plurality of masses being divided into two arrays, each array including one or more individual masses, wherein, the arrays of masses damp resonant vibrations in the zones to which they are applied, thereby inducing resonant vibrations in remaining undamped zones on the diaphragm.

According to another aspect, the invention provides a method of manufacture of a diaphragm, the method including placing a plurality of masses on the diaphragm, each mass being substantially the same distance from the centre of the diaphragm, wherein, the masses are divided into two or more arrays, each array including one or more masses, and the spacing between subsequent masses in each array is smaller than the spacing between subsequent arrays.

In another aspect, the invention provides a diaphragm for a loud speaker having a plurality of masses, the plurality of masses being divided into two arrays, each array including one or more individual masses, each array extending in the circumferential direction around the diaphragm, wherein, in use, at a selected frequency, the pair of arrays acts to produce a dominant bending moment, and, the centre of the diaphragm lies substantially on the axis of the dominant bending moment, wherein, the dominant bending moment is the bending moment produced by the combination of masses which has the greatest magnitude, if they produce more than one bending moment.

In a further aspect, the invention may provide a diaphragm for a loudspeaker having a plurality of masses distributed about its centre, at a given radius where the amplitude of vibration of ring resonance would be maximal at a certain frequency, the masses arranged such that they produce a dominant bending moment, and, the centre of the diaphragm lies substantially on the axis of the dominant bending moment, wherein, the dominant bending moment is the bending moment produced by the combination of masses which has the greatest magnitude, if they produce more than one bending moment.

In another aspect, the invention provides a diaphragm for a loud speaker having a plurality of masses distributed about its centre, along a pathway where the amplitude of vibration of ring resonance would be maximal at a certain frequency, the masses arranged such that they produce a dominant bending moment, and, the centre of the diaphragm lies substantially on the axis of the dominant bending moment, wherein, the dominant bending moment is the bending moment produced by the combination of masses which has the greatest magnitude, if they produce more than one bending moment.

The invention includes any combination of the aspects and preferred features described except where such a combination is clearly impermissible or expressly avoided.

Embodiments of our proposals are discussed below, with reference to the accompanying drawings in which:

FIG. 8 shows a laser vibrometer scan of the surface of a loudspeaker diaphragm.

FIG. 9 shows a laser vibrometer scan of the surface of a loudspeaker diaphragm.

FIG. 10 shows a laser vibrometer scan of the surface of a loudspeaker diaphragm.

FIG. 21 shows a variant of a segmented mass attached to a diaphragm for a loudspeaker with adhesive.

FIG. 22 shows a variant of a segmented mass attached to a diaphragm where the mass is a drop of glue.

FIG. 23 shows a variant of a segmented mass attached to a diaphragm where the mass is integrated with roll suspension, which suspends the diaphragm within the loudspeaker.

FIG. 24 shows a variant of a segmented mass attached to a diaphragm where the mass is integrated with roll suspension, which suspends the diaphragm within the loudspeaker.

Figure 1:
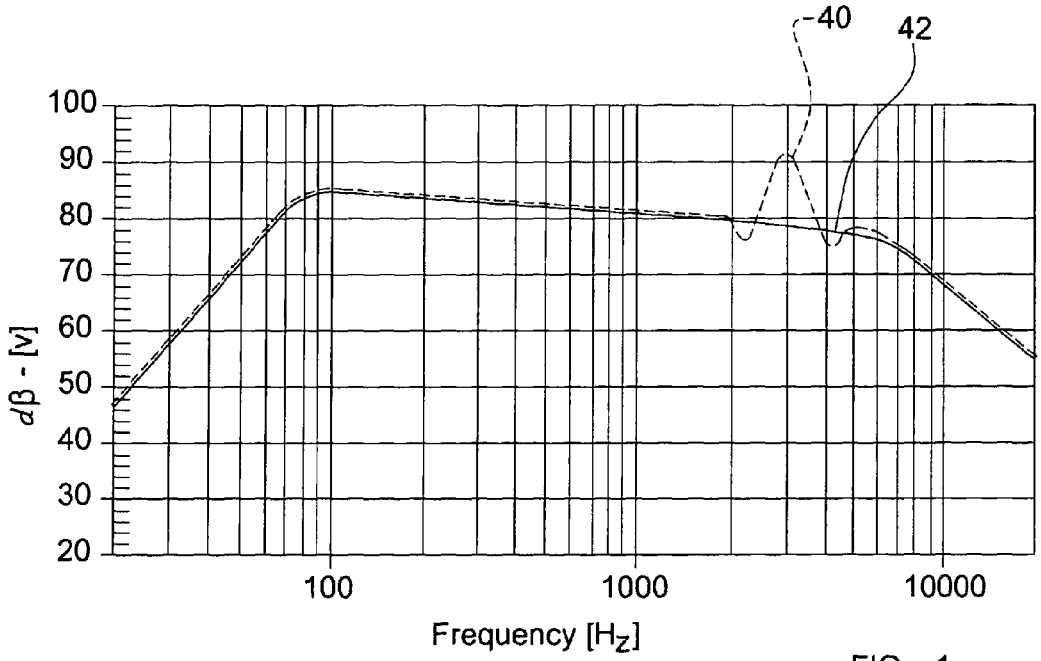
FIG. 1 illustrates a Sound Pressure Level (SPL) curve change for a diaphragm after segmented masses have been applied to the diaphragm.

FIG. 1 illustrates a Sound Pressure Level (SPL) curve for a diaphragm of a loudspeaker over a range of frequencies. Dashed line 40 represents the response without the segmented mass arrays applied. As can be seen resonance occurs for this particular diaphragm between 2 KHz and 5 KHz. The solid line 42 shows the frequency response of the same diaphragm after segmented masses have been applied, and it can be seen that the resonance has been smoothed out.

Prior art has tried to address the issue of diaphragm break up by using annular mass loading to damp the resonant vibrations in a diaphragm. This has proved to be unsuccessful as it simply lowers the frequency at which the diaphragm resonates, as shown by the solid line in FIG. 2.

Figure 2:
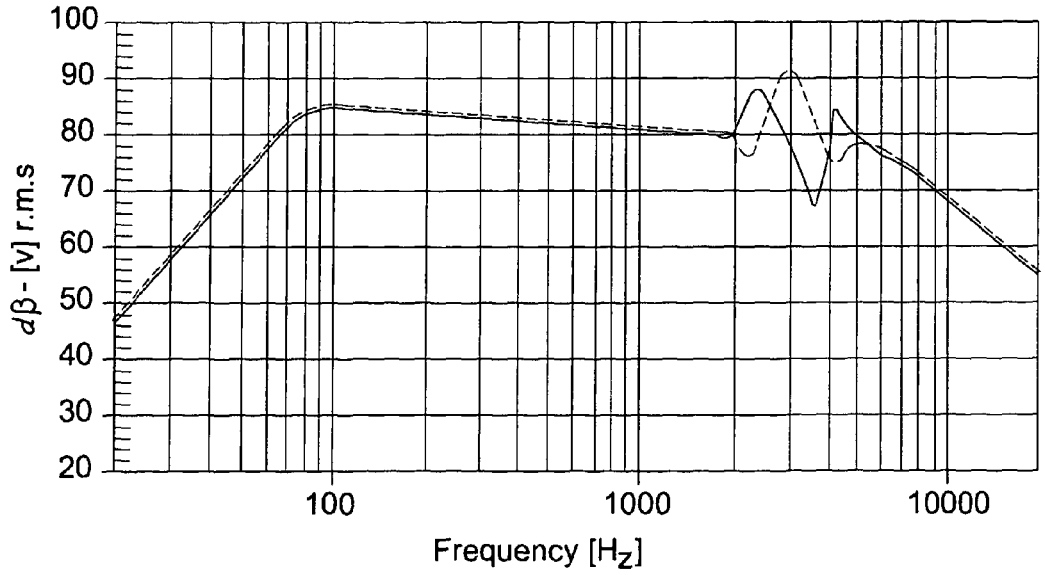
FIG 2 PRIOR ART
FIG. 2 shows a Sound Pressure Level (SPL) curve change for a diaphragm when annular loading have been applied to the diaphragm.
Figure 3:
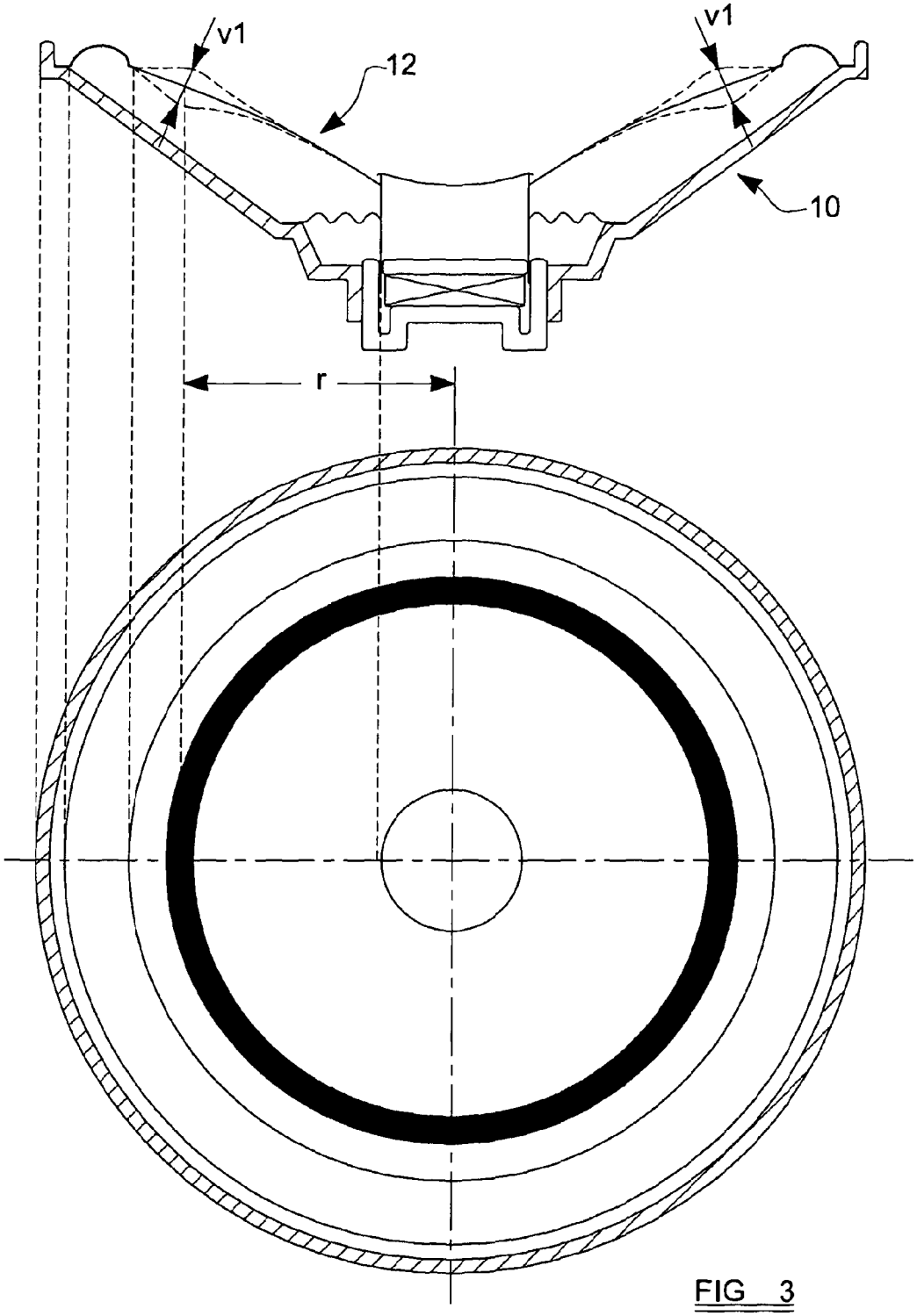
FIG. 3 shows a loudspeaker operating in a resonant break up mode.
Figure 4:
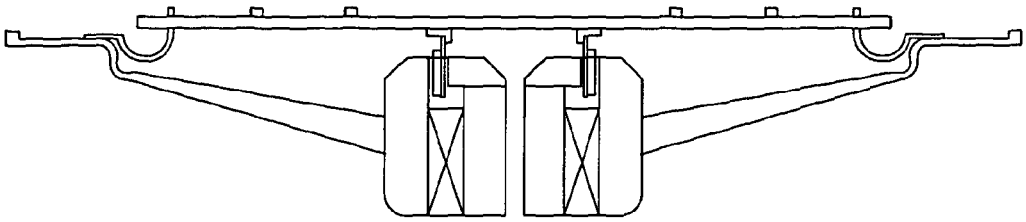
FIG 4 PRIOR ART
FIG. 4 shows a loudspeaker with mechanical impedance rings attached to its diaphragm.
Figure 4:
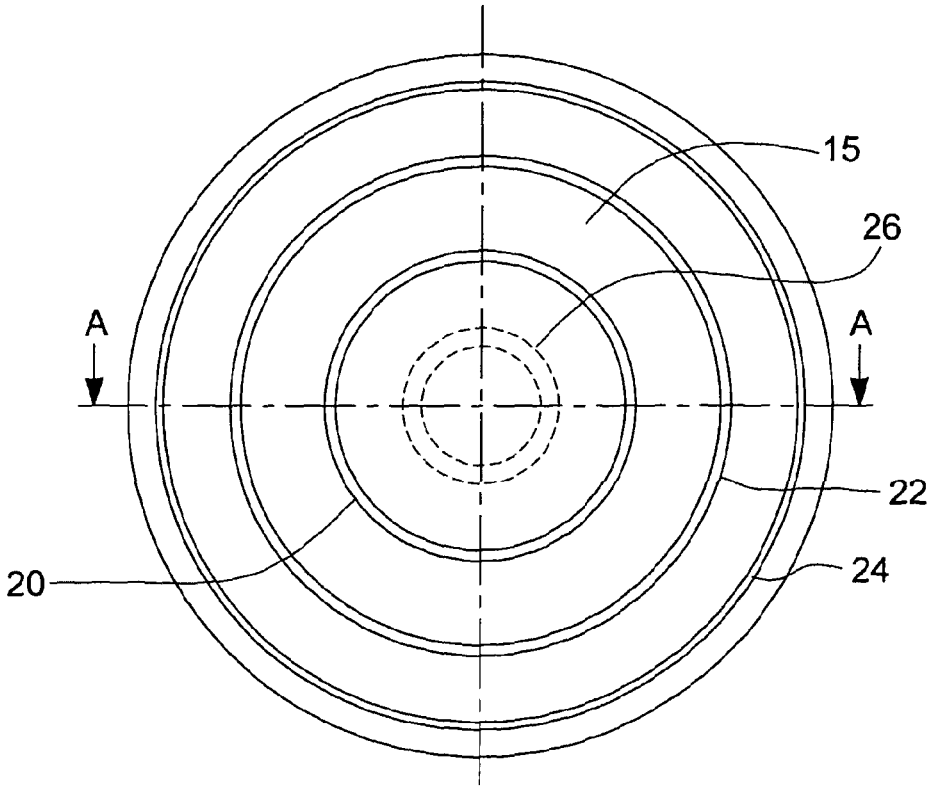
FIG 4 PRIOR ART

FIG. 3 shows a loudspeaker 10, having a diaphragm 12, which is operating in a break up mode. The diaphragm 12 is experiencing resonant vibrations of amplitude v1 at a radius r from the centre of the speaker. FIG. 4 shows an attempt to ameliorate this break up by the application of mechanical impedance means. The diaphragm 15 has rings 20, 22, 24 located around the voice coil 26. Unfortunately, this does not address the break up issue and simply moves it to a lower frequency as seen in FIG. 2.

Figure 5:
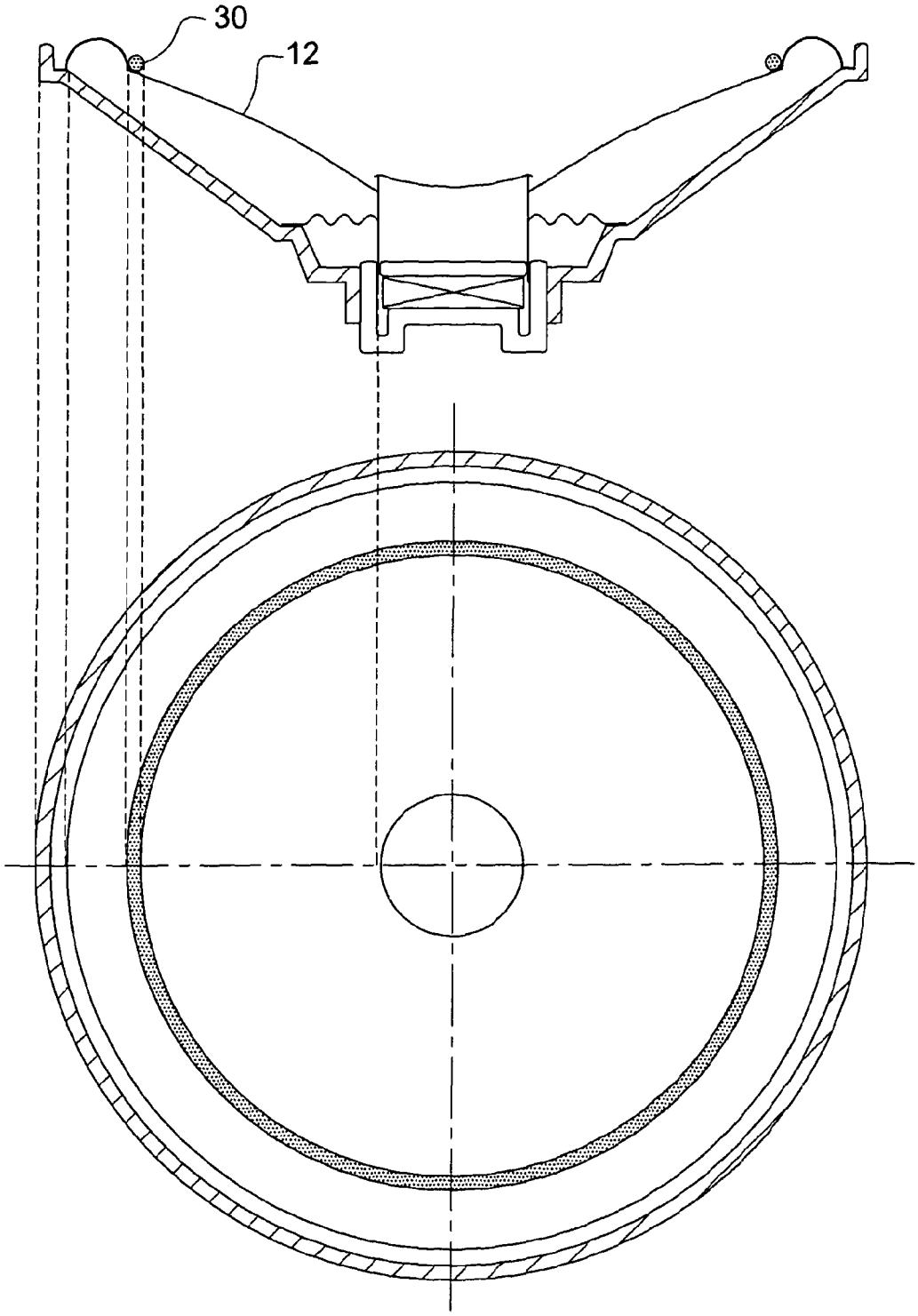
FIG 5 PRIOR ART
FIG. 5 shows a loudspeaker with annular mass loading positioned adjacent its rim.
Figure 6:
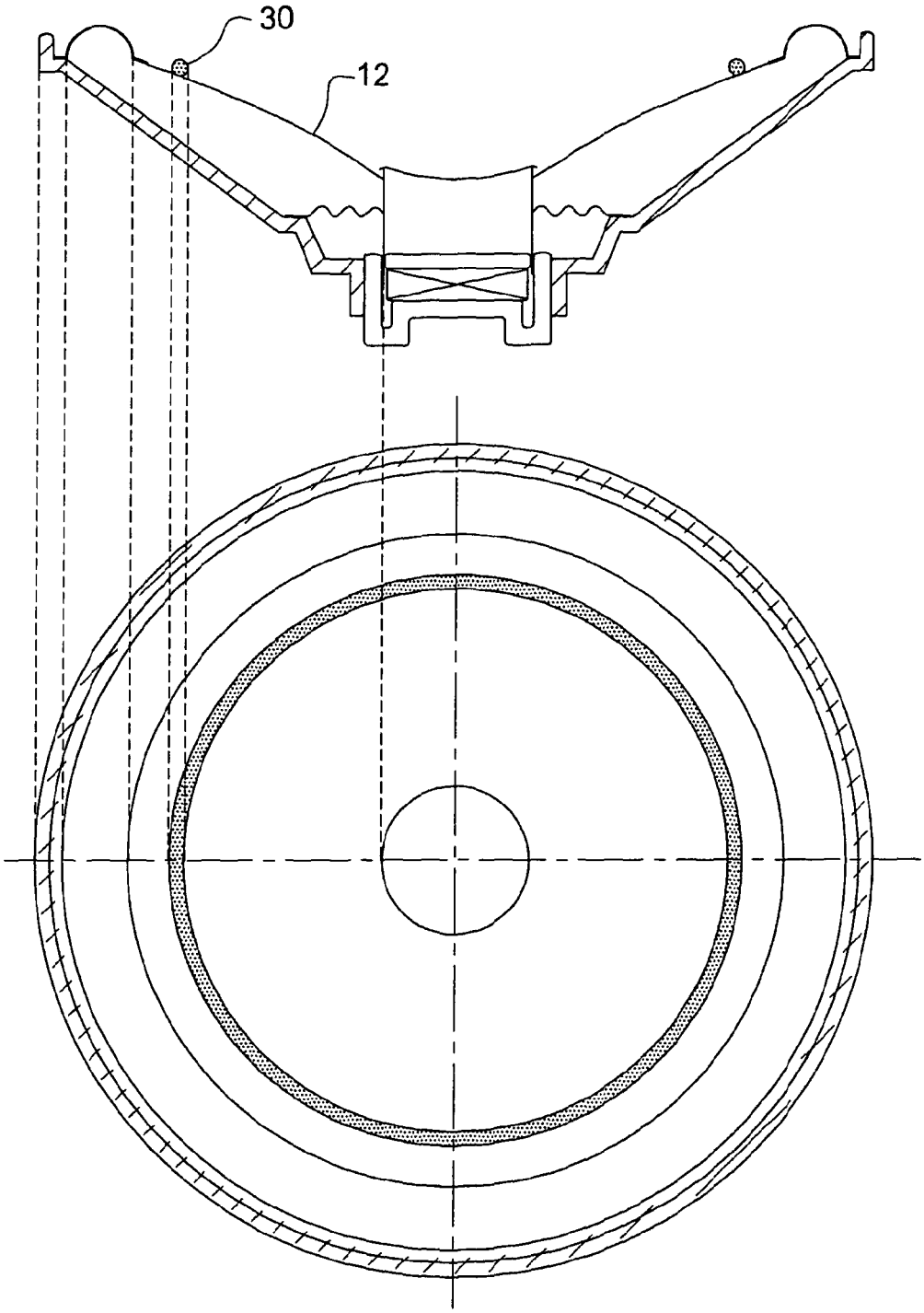
FIG 6 PRIOR ART
FIG. 6 shows a loudspeaker with annular mass loading positioned inwards from its rim.

FIG. 5 shows an attempt at annular mass loading to address break up towards the edge of the diaphragm 12 by placement of annular mass 30 adjacent the edge of the diaphragm 12 and FIG. 6 shows an attempt to address break up inwards from the edge of the diaphragm 12 by placement of annular mass 30 inwards from the edge of diaphragm 12. Both have the effect of transitioning the break up a lower frequency as shown in FIG. 2.

Figure 7:
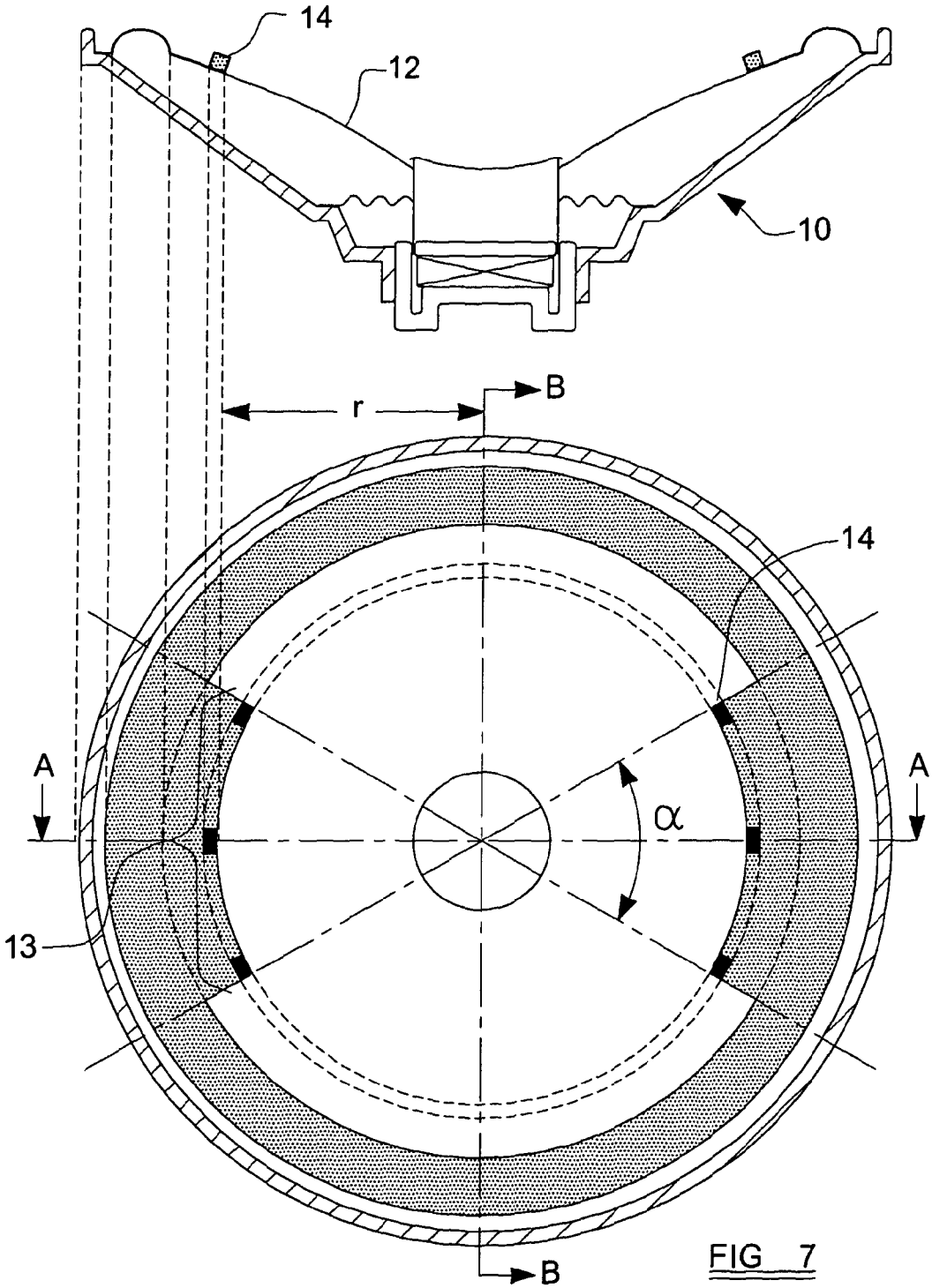
FIG. 7 shows a loudspeaker with two symmetrical arrays of masses applied.

FIG. 7 shows a loudspeaker 10 in accordance with an aspect of the invention. The diaphragm 12 of loudspeaker 10 has two arrays 13 of segmented masses 14 attached, symmetrically about a diameter (line B-B), at a predefined radius r. This radius r has been chosen as this is the radius at which the amplitude of targeted resonant vibrations would be maximal at a certain frequency. The arrays are disturbed about an opening angle of the diaphragm $\alpha$, in this case 60°. This could however be any other angle, perhaps 30°, 45°, or even 90°, dependant upon requirements. When the speaker is operating at a certain frequency where resonant vibrations occur at this radius, then, the vibrations of the portions of the diaphragm covered by these segmented masses 14 are damped, meaning that the vibration of the diaphragm is damped about line A-A. The rest of the diaphragm continues to vibrate and a maximum bending moment is induced along line B-B, which is orthogonal to the line of maximum damping or stiffness, A-A. This breaks up the resonant ring vibrations, which would normally exist in a ring around the diaphragm 12, at radius r, making them non-uniform.

It will be apparent to one skilled in the art that the distribution of two arrays of masses on the diaphragm is simply one way of implementing the invention. In fact, as long as damping is provided in some segments of the diaphragm, a maximum bending moment may be induced in the undamped portions. Usually this is implemented by distribution of some damping means along a diameter of the diaphragm (where the diaphragm is substantially circular), such that a maximum bending moment will be induced orthogonal to the line of maximum damping. This may be achieved, as above, with masses organised into circumferential arrays, but could easily also be implemented by other arrangements of masses into groupings in some segments of the diaphragm. It will of course be understood that the invention does not have to implemented on solely circular diaphragms, and that it can be implemented on diaphragms of virtually any shape. In these cases, damping means are provided so that the line of maximum damping is provided across the surface of the diaphragm such that it passes substantially through the centre of the diaphragm as it may not always be simple to define a 'diameter' of the diaphragm (for example, where it is elliptically shaped).

In further embodiments, the invention may be implemented without the distribution of masses at all, where other damping means have been applied. For example, if a circular diaphragm has radially extending ribs on some of its surface, these will increase stiffness along their length and therefore damp vibrations in the segments in which they are applied. A maximum bending moment will thus be induced in areas where the stiffness has not been increased. It is also possible to foresee a composite diaphragm, in accordance with the invention, where different areas have different stiffnesses, or other damping properties, such that vibrations in these areas are damped, without the need for application of further damping means.

FIGS. 8, 9 and 10 show laser vibrometer scans of the surface of a loudspeaker 10 vibrating at approximately 3 kHz, which is the frequency of ring shaped resonance for said loudspeaker that causes an unwanted peak in the frequency response. These scans show the amplitude of vibration of areas of the speaker by greyscale shading. Dark areas correspond with areas on the diaphragm with high amplitude vibrations whereas lighter areas correspond with areas that are vibrating with lower amplitude.

FIG. 8 shows the speaker's 10 vibration without any mass arrays applied. As shown, there is a dark ring towards the edge of the diaphragm, indicating ring resonance at this radius around the diaphragm. FIG. 9 shows the same speaker with arrays of masses 14 applied to the diaphragm, at an opening angle of about 90°. It is clear that the amplitude of the diaphragm at the targeted radius is no longer uniform. These masses damp the vibration in the areas applied (seen as lighter patches) and allow the remaining areas to continue vibrating (seen as darker patches). This induces a maximal bending moment about line B-B, and allows the ring shaped resonance to be broken up.

FIG. 10 shows the same speaker with slightly varied arrays of segmented masses, in accordance with an embodiment of the invention.

In this case the mass arrays are integral with the resilient rubber roll-suspension, as shown further in FIGS. 23 and 24. It is clear that the amplitude of the diaphragm at the targeted radius is no longer uniform.

Figure 11:
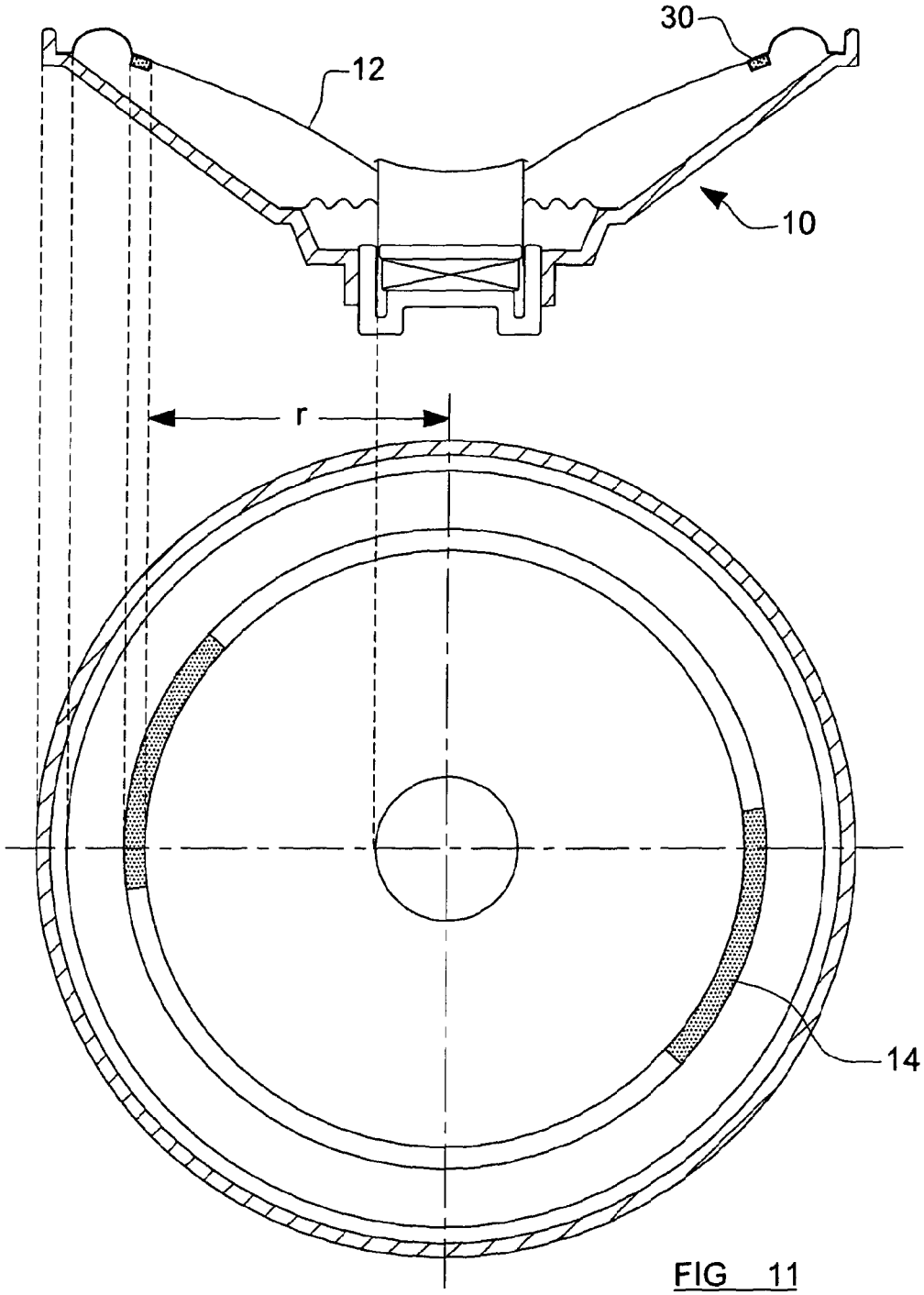
FIG. 11 shows a loudspeaker with two symmetrical single masses applied.

FIG. 11 shows an embodiment of the invention where the arrays are formed from single masses 14 extending circumferentially around the diaphragm 12 of the speaker 10, at radius r. These arrays work in the same fashion as arrays of multiple masses to disrupt the targeted resonant vibration and induce a maximum bending moment in the diaphragm (not shown).

Figure 12:
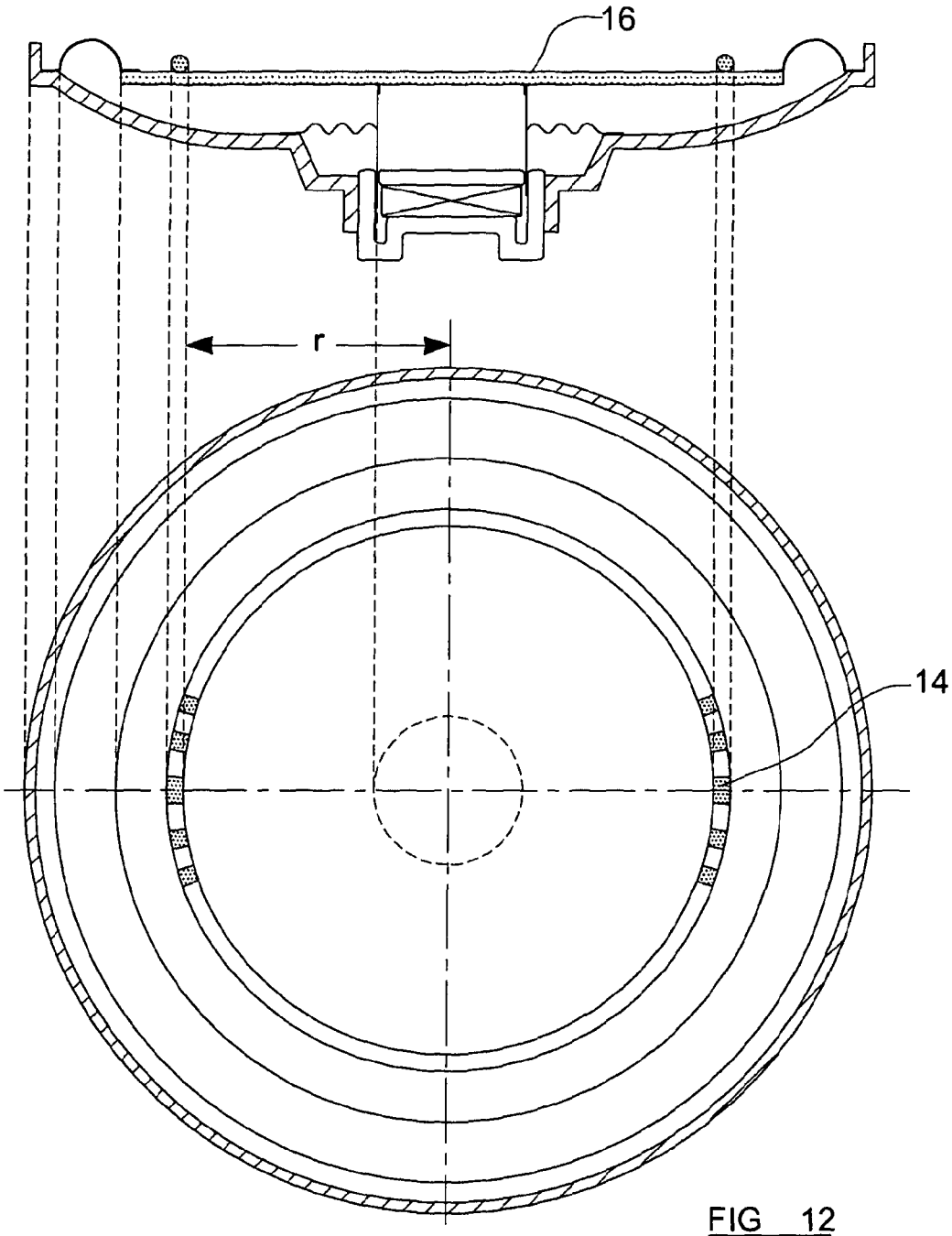
FIG. 12 shows a loudspeaker with a flat diaphragm and two symmetrical arrays of segmented masses applied.

FIG. 12 shows an embodiment in accordance with a further aspect of the invention. In this instance, two arrays of segmented masses 14 are placed symmetrically about a diameter of the diaphragm 16 at a radius r. In this case, the diaphragm is flat instead of conical, but the invention works in the same manner as described with reference to FIG. 7.

Figure 13:
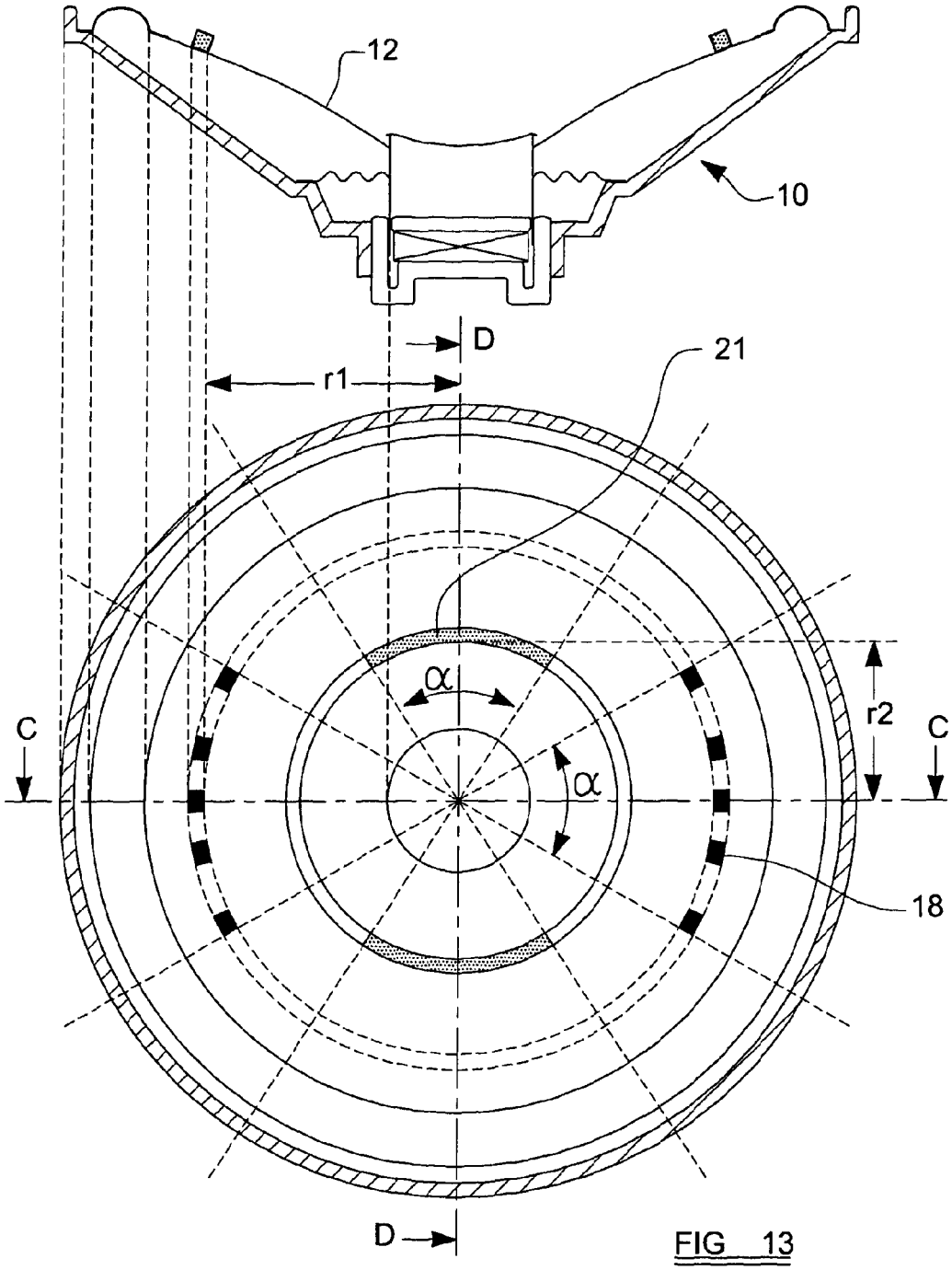
FIG. 13 shows a loudspeaker with two pairs of symmetrical arrays of segmented masses applied.

FIG. 13 shows an aspect of the invention wherein four arrays of segmented masses have been applied to the diaphragm 12 of the loudspeaker 10, in two pairs. A first pair of arrays 18 are positioned at radius r1 from the centre of the diaphragm, positioned to interrupt ring resonance vibrations at this point. This induces a maximum bending moment along line D-D in a similar fashion as described with reference to FIG. 7. In this case, there is also a second pair of arrays 21 positioned at radius r2 from the centre of the diaphragm, positioned to interrupt a ring resonance at this radius. These, as before, damp resonant vibrations where they are positioned and induce a maximum bending moment along line C-C. Using this method, two distinct areas where ring resonance occurs at a certain frequency can be targeted. In this case, each array is distributed about an opening angle $\alpha$ of 60°.

Also shown in FIG. 13 are some possible arrangements of masses within an array. In array 18, there are 5 masses equally distributed about a circumferential path. This means that they are positioned linearly along a path which is aligned with the circumference of the diaphragm, in this case a circle. Array 21 is formed from a single mass which itself extends along a circumferential path. It is possible that the arrays could be formed from 1, 2, 3, 4, 5, 6, or any number of masses, dependant on requirements and performance as determined experimentally.

Figure 14:
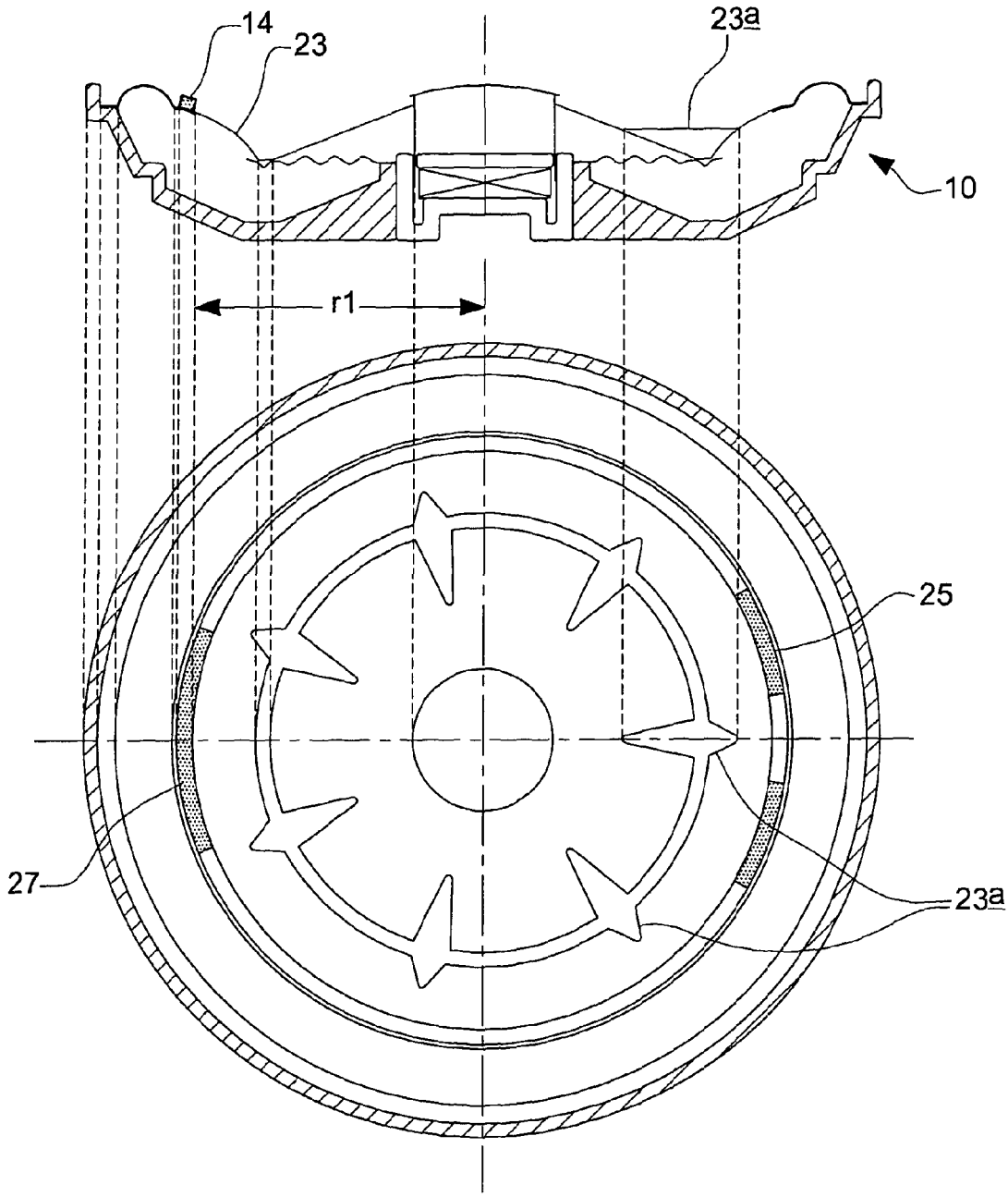
FIG. 14 shows a loudspeaker having a diaphragm with two non-symmetrical arrays of segmented masses applied.

FIG. 14 shows a further aspect of the invention where the segmented masses across two arrays are not symmetrical. In this case, the arrays of masses 14 have been placed at radius r from the centre of the diaphragm 23 of loudspeaker 10, as this is the radius at which ring resonant vibration occurs at a certain frequency. The diaphragm 22 in this case has a non-conoidal shape that is different from those shapes shown previously, being in the form of an annular dish with a pattern of folds 23*a* formed therein. This indicates that the invention can be used on a range of diaphragm shapes, not limited to what has been shown here.

One array 27 is formed from a single mass, which extends in the circumferential direction, whereas the other array 25 is formed from two segmented masses, which are substantially the same distance from the centre of the diaphragm 23. This indicates that a variety of mass array configurations are possible, and these are not limited to the examples shown here. As long as a maximum bending moment is induced between the damping segmented masses, many combinations of arrays and masses are possible.

Figure 15:
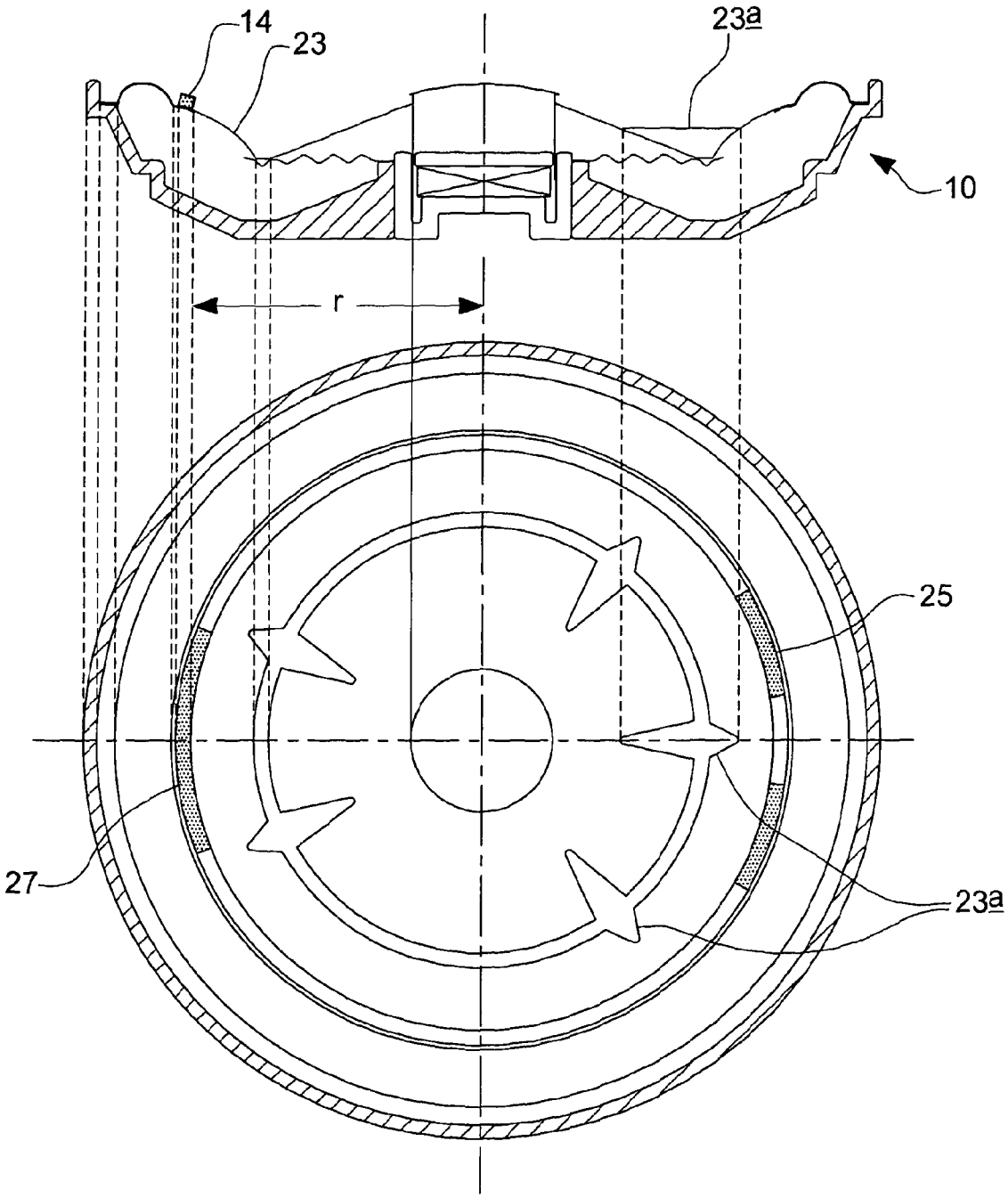
FIG. 15 shows a modified version of the loudspeaker shown in FIG. 14.

FIG. 15 shows a modified version of the diaphragm 23 shown in FIG. 14. As in FIG. 14, the segmented masses are not symmetrical and the diaphragm 23 of the loudspeaker 10 is in the form of an annular dish with a pattern of folds 23*a* formed therein. Also as in FIG. 14, the arrays of masses 14 have been placed at radius r from the centre of the diaphragm 23 of loudspeaker 10, as this is the radius at which ring resonant vibration occurs at a certain frequency. However, unlike FIG. 14, the folds 23*a* formed in the diaphragm 23 shown in FIG. 15 are distributed in an irregular pattern, rather than the regular pattern shown in FIG. 14. Also, there are fewer folds 23*a* in the diaphragm of FIG. 15. Again, this indicates that the invention can be used on a range of diaphragm shapes, not limited to what has been shown here.

Figure 16:
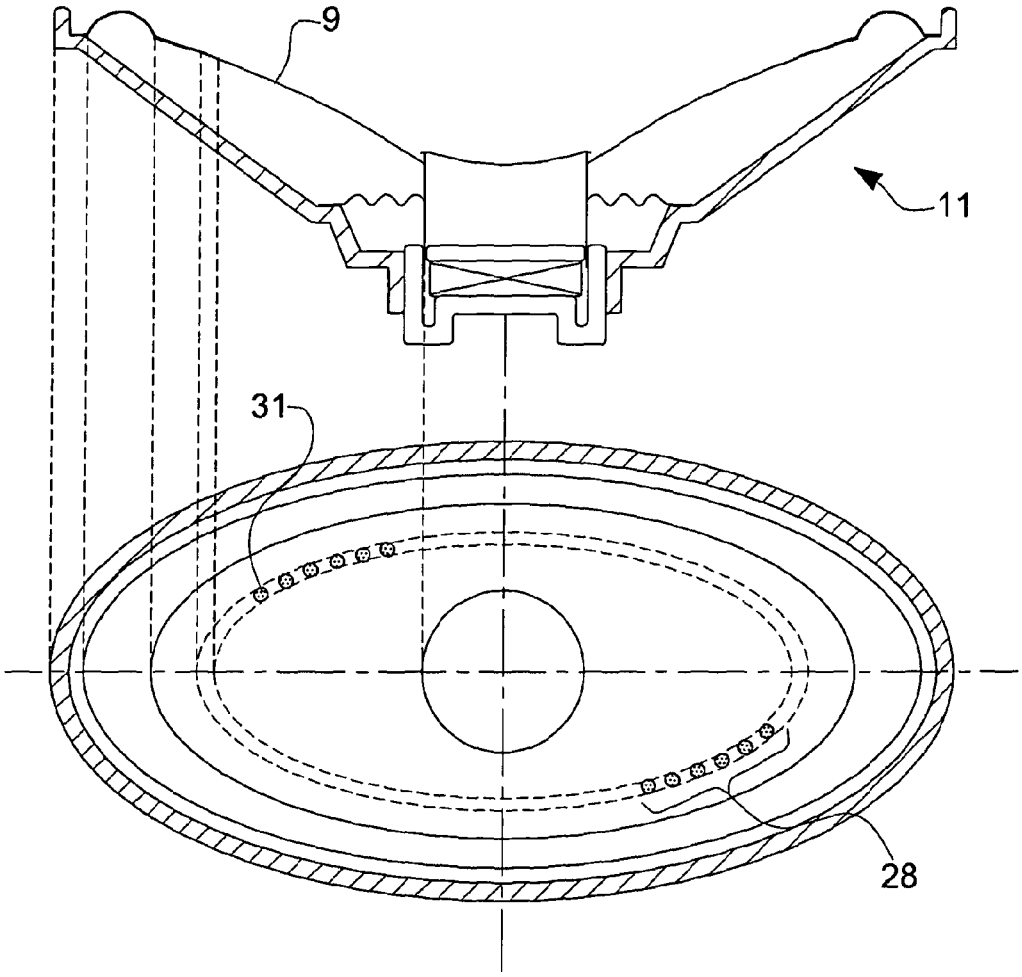
FIG. 16 shows an elliptical loudspeaker with two arrays of segmented masses attached.

FIG. 16 shows an embodiment of the invention, where masses 31 are fixed to an elliptical diaphragm 9 of elliptical speaker 11. The masses 31 are grouped together in two arrays 28, which follow a circumferential, in this case elliptical, path. They are positioned in this format as in this case the ring resonance would follow an elliptical route, and these masses will damp the vibration at their specific locations on the diaphragm. Of course, it will be apparent to one skilled in the art that the invention could be employed in many different shapes of diaphragms to damp specific ring resonance vibrations and induce a maximum bending moment.

FIGS. 17, 18, 19 and 20 show in more detail the maximum bending moments that are induced.

Figure 17:
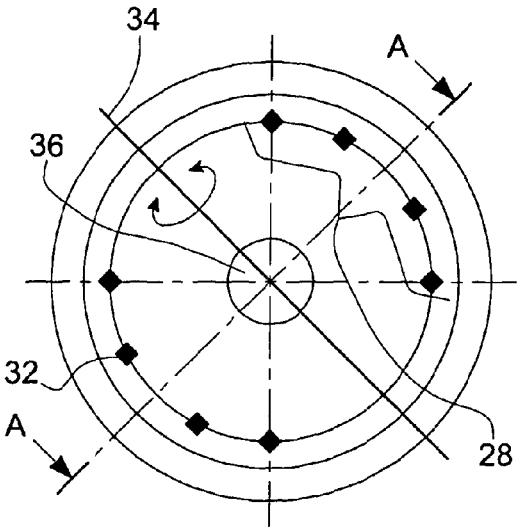
FIG. 17 shows the dominant bending moment induced by one embodiment of the invention on a diaphragm for a loudspeaker.

In FIG. 17, the two arrays 28 of masses 32 are distributed about line A-A. Line A-A is therefore the line of maximum damping, and the area of the diaphragm along this line will there act substantially in piston mode with voice coil 36. Piston mode is when an element of the diaphragm moves back and forth with the voice coil with very little or no phase difference. As the area of diaphragm along line 34 is not damped, it will resonate at a certain frequency at which ring resonance would normally occur. The diameter of the diaphragm which passes through the centre of this area, line 34, will therefore be the line of maximum bending moment, which is orthogonal to the line of the centre of the arrays, A-A.

Figure 18:
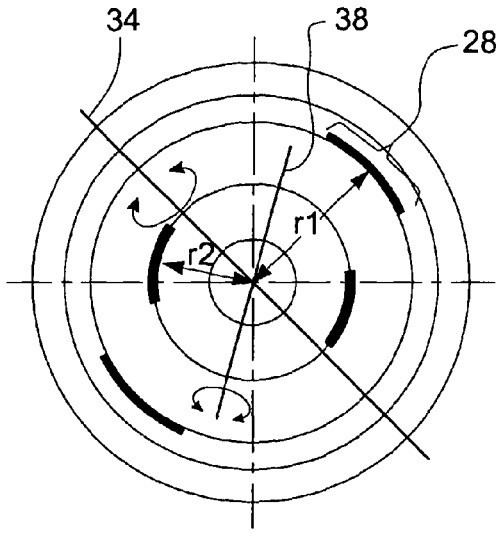
FIG. 18 shows the dominant bending moment induced by one embodiment of the invention on a diaphragm for a loudspeaker.

FIG. 18 shows a similar arrangement, except that arrays 28 of masses 32 include only two masses, which are of a different shape to those of FIG. 17. These act in substantially the same way though to break up ring resonance at a certain frequency, and induce a maximum bending moment 34.

Figure 19:
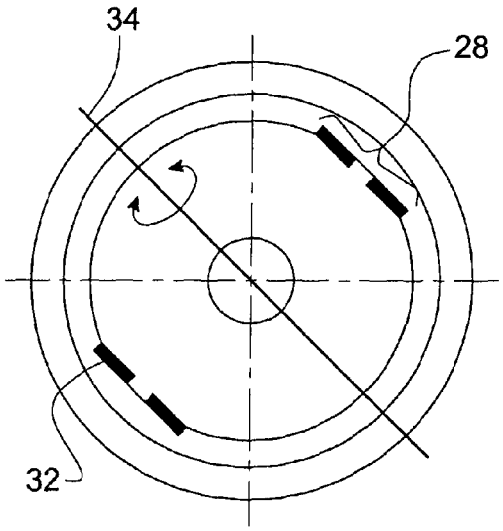
FIG. 19 shows the dominant bending moment induced by one embodiment of the invention on a diaphragm for a loudspeaker.

FIG. 19 shows a scenario where two sets of symmetrical arrays are applied to different areas of the diaphragm, similar to as shown in FIG. 13. A first pair of arrays is attached to the diaphragm at radius r1 from the centre of the diaphragm, to interrupt ring resonances at this point. This will induce a first maximum bending moment 34, orthogonal to the diameter which passes through the centre of the arrays. In this case however, there is a second pair of arrays at radius r2 from the centre of the diaphragm. These are placed to interrupt a ring resonance at radius r2 at a certain frequency. Again they damp the sections of the diaphragm to which they are applied and induce a maximum bending moment along line 38. In FIG. 18, therefore, there are two maximum bending moments generated where two ring resonances (at radius r1 and radius r2) are interrupted.

Figure 20:
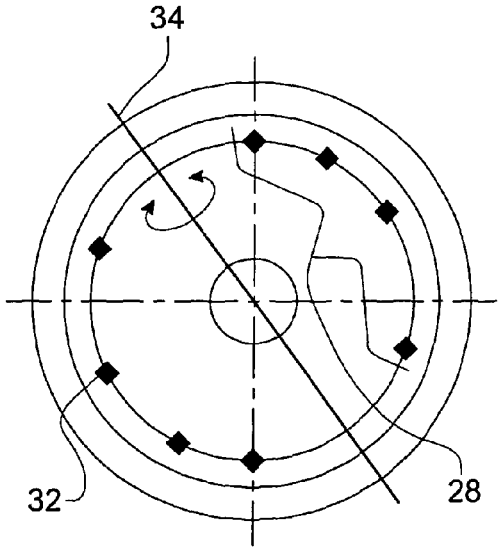
FIG. 20 shows the dominant bending moment induced by one embodiment of the invention on a diaphragm for a loudspeaker.

FIG. 20 illustrates a scenario where the spacing between subsequent masses 32 in each array 30 is not constant. In fact, in this scenario, they are shown to be distributed circumferentially with increasing spacing. This has been found to work effectively to break up ring resonance and as before a maximum bending moment is developed along line 34. It will of course be understood by one skilled in the art that this 'increasing gap' formation is just one example of many embodiments with non-regular spacing between masses in arrays.

FIGS. 21 to 26 show possible configurations of the masses 44 used in the segmented mass loading of a diaphragm 46.

FIG. 21 shows a mass 44 attached to diaphragm 46 by adhesive 50. Commonly the mass 44 is a rubber block, metal staple, etc. Masses which have a high loss factor (due to internal damping) do have an improved smoothing effect on the SPL response curve (FIG. 20). A range of adhesives 50 can be used to attach the mass 44 to the diaphragm 46, but it has been found that using an adhesive that has a high loss factor (due to internal damping) has a smoothing effect on the SPL curve also.

FIG. 22 shows an embodiment where the mass 44 is formed from a drop of glue onto the surface of the diaphragm 46. In this embodiment, no joining adhesive is necessary due to the adhesive properties of the drop of glue 44, and again glue which has a high loss factor due to internal damping will produce a smoother SPL curve.

FIG. 23 shows an embodiment where the diaphragm 46 is mounted on a mount (not shown) by a roll suspension 48, and the masses 44 are formed from the roll suspension 48. No adhesive is therefore necessary to attach the mass separately. In this embodiment, the integrated masses 44 are on the rear side of the diaphragm 46.

In FIG. 24, the masses 44 are similarly integrated with the roll suspension 48, but are in this instance attached to the front side of a flat diaphragm 46.

Figure 25:
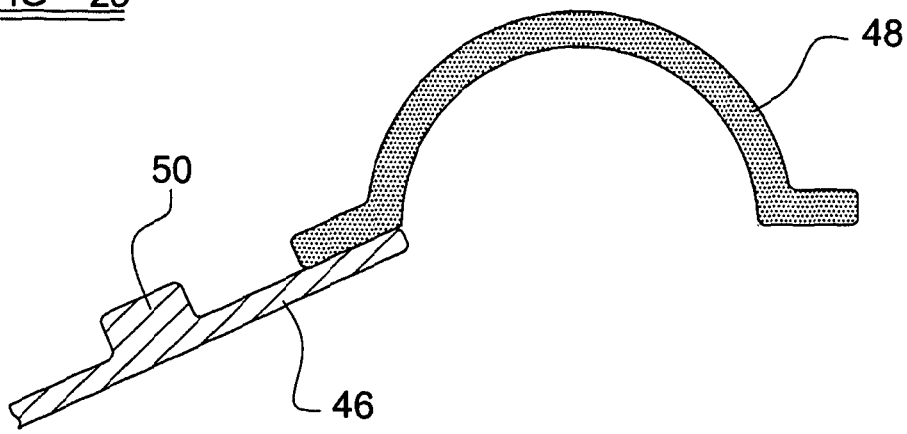
FIG. 25 shows a variant of a segmented mass attached to a diaphragm where the mass is integrated with the diaphragm.

In FIG. 25, the masses 50 are integrated (integral) with the diaphragm 46. This could reduce manufacturing costs and improve manufacturing efficiency as an extra assembly step of applying masses is not required. In this instance, the masses 50 have simply been formed as part of the diaphragm 46.

Figure 26:
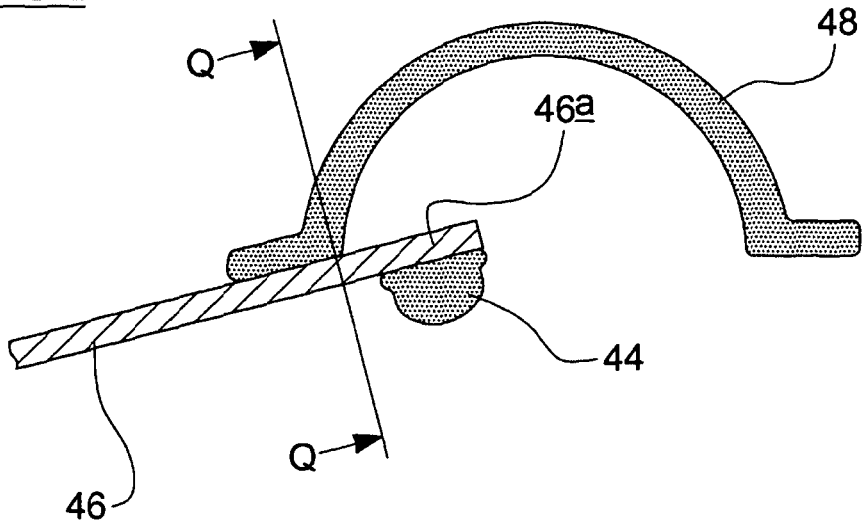
FIG. 26 shows a variant of a segmented mass attached to a diaphragm where the mass is positioned at the edge of the diaphragm.

In FIG. 26, the outer edge 46*a* of the diaphragm 46 projects slightly beyond the join with the roll suspension 48. In this case, the resonant frequencies being targeted occur at the outer edge of the diaphragm and the masses 44 (formed in this example from drops of glue) have been positioned at said outer edge 46*a* accordingly. Here the masses 44 have been applied to the underside of the diaphragm (the side opposite the attachment of the roll suspension 48) so as not to interfere with the roll suspension 48 during use. It should, of course, be noted that the masses 44 could be applied to either side of the diaphragm 46.

Although FIG. 26 shows a circular diaphragm 46 whose outer edge 46*a* projects slightly beyond the join with the roll suspension 48, it should also be noted, with reference to FIG. 26, that the diaphragm 46 need not be circular. If it is desirable for masses 44 to be located beyond the join with the roll suspension 48, the outer edge of the diaphragm 46 may terminate at the join with the roll suspension along at least a portion of its circumference, e.g. at line Q-Q shown in FIG. 26, with only the portions of the diaphragm 46 where masses 44 are to be applied protruding beyond this join.

One of ordinary skill after reading the foregoing description will be able to affect various changes, alterations, and subtractions of equivalents without departing from the broad concepts disclosed. It is therefore intended that the scope of the patent granted hereon be limited only by the appended claims, as interpreted with reference to the description and drawings, and not by limitation of the embodiments described herein.

The invention claimed is:

1. A diaphragm for a loudspeaker including a plurality of masses, each mass being substantially the same radial distance from the center of the diaphragm, the plurality of masses being divided into two symmetrical portions of masses, each portion including one or more individual masses, wherein, in use, at a selected frequency, the pair of portions act to produce a dominant bending moment, and, the center of the diaphragm lies substantially on the axis of the dominant bending moment, wherein, the dominant bending moment is the bending moment produced by the combination of masses which has the greatest magnitude, if they produce more than one bending moment.

2. A diaphragm according to claim 1, wherein each or any portion of masses contains only one mass.

3. A diaphragm according to claim 1 further comprising:

a second plurality of masses divided into two further portions, each portion including one or more individual masses, wherein, in use, at a selected frequency, the pair of further portions act to produce a second dominant bending moment, and, the centre of the diaphragm lies substantially on the axis of the dominant bending moment, each mass in the second plurality of masses is substantially the same radial distance from the centre of the diaphragm, wherein, this distance is different from that of the first plurality of masses.

4. A diaphragm according to claim 1 wherein the masses are formed from an elastic, or internally damped, material is formed from rubber, silicone, foam rubber, or other product with an elastic modulus of less than 1 GPa.

5. A diaphragm according to claim 1 further comprising an annular roll suspension adjoining the outer circumference of the diaphragm to a mount, the suspension suspending the diaphragm from the mount, wherein, at least one of the plurality of masses are integrated with the annular roll suspension.

6. A diaphragm for a loudspeaker according to claim 1 further comprising:

in use, at a selected frequency, the pair of portions act to damp resonance in areas of the diaphragm to which to they are attached, thereby reducing ring resonance around the surface of the diaphragm at said radial distance.

7. A diaphragm for a loud speaker according to claim 1 further comprising:

each portion extending in an elliptical pathway around the diaphragm.

8. A diaphragm for a loud speaker according to claim 1 further comprising:

each portion extending in the circumferential direction around the diaphragm.

9. A diaphragm for a loudspeaker including a plurality of masses, each mass being substantially the same radial distance from the centre of the diaphragm, the masses being divided into two portions, each portion including one or more individual masses, each portion being distributed about an opening angle of the diaphragm $\alpha$, where $\alpha$ is less than or equal to 90°, wherein in use, at a selected frequency, the pair of portions act to produce a dominant bending moment, and, the centre of the diaphragm lies substantially on the axis of the dominant bending moment, wherein, the dominant bending moment is the bending moment produced by the combination of masses which has the greatest magnitude, if they produce more than one bending moment.

10. A diaphragm according to claim 9, wherein each or any portion of masses contains only one mass.

11. A diaphragm according to claim 9 further comprising:

a second plurality of masses divided into two further portions, each portion including one or more individual masses, wherein, in use, at a selected frequency, the pair of further portions act to produce a second dominant bending moment, and, the centre of the diaphragm lies substantially on the axis of the dominant bending moment, each mass in the second plurality of masses is substantially the same radial distance from the centre of the diaphragm, wherein, this distance is different from that of the first plurality of masses.

12. A diaphragm according to claim 9 wherein the masses are formed from an elastic, or internally damped, material is formed from rubber, silicone, foam rubber, or other product with an elastic modulus of less than 1 GPa.

13. A diaphragm according to claim 9 further comprising an annular roll suspension adjoining the outer circumference of the diaphragm to a mount, the suspension suspending the diaphragm from the mount, wherein, at least one of the plurality of masses are integrated with the annular roll suspension.

14. A diaphragm for a loudspeaker according to claim 9 further comprising:

in use, at a selected frequency, the pair of portions act to damp resonance in areas of the diaphragm to which to they are attached, thereby reducing ring resonance around the surface of the diaphragm at said radial distance.

15. A diaphragm for a loud speaker according to claim 9 further comprising:

each portion extending in an elliptical pathway around the diaphragm.

16. A diaphragm for a loud speaker according to claim 9 further comprising:

each portion extending in the circumferential direction around the diaphragm.

17. A diaphragm for a loudspeaker including a plurality of masses, each mass being substantially the same radial distance from the centre of the diaphragm, the masses being divided into two portions, each portion including one or more individual masses, the element of a portion as distributed such as to prohibit a 90° rotational symmetry, wherein in use, at a selected frequency, the pair of portions act to produce a dominant bending moment, and, the centre of the diaphragm lies substantially on the axis of the dominant bending moment, wherein, the dominant bending moment is the bending moment produced by the combination of masses which has the greatest magnitude, if they produce more than one bending moment.

18. A diaphragm according to claim 17, wherein each or any portion of masses contains only one mass.

19. A diaphragm according to claim 17 further comprising:

a second plurality of masses divided into two further portions, each portion including one or more individual masses, wherein, in use, at a selected frequency, the pair of further portions act to produce a second dominant bending moment, and, the centre of the diaphragm lies substantially on the axis of the dominant bending moment, each mass in the second plurality of masses is substantially the same radial distance from the centre of the diaphragm, wherein, this distance is different from that of the first plurality of masses.

20. A diaphragm according to claim 17 wherein the masses are formed from an elastic, or internally damped, material is formed from rubber, silicone, foam rubber, or other product with an elastic modulus of less than 1 GPa.

21. A diaphragm according to claim 17 further comprising an annular roll suspension adjoining the outer circumference of the diaphragm to a mount, the suspension suspending the diaphragm from the mount, wherein, at least one of the plurality of masses are integrated with the annular roll suspension.

22. A diaphragm for a loudspeaker according to claim 17 further comprising:

in use, at a selected frequency, the pair of portions act to damp resonance in areas of the diaphragm to which to they are attached, thereby reducing ring resonance around the surface of the diaphragm at said radial distance.

23. A diaphragm for a loud speaker according to claim 17 further comprising:

each portion extending in an elliptical pathway around the diaphragm.

24. A diaphragm for a loud speaker according to claim 17 further comprising:

each portion extending in the circumferential direction around the diaphragm.

* * * * *